US011926984B2

(12) United States Patent
Derry et al.

(10) Patent No.: US 11,926,984 B2
(45) Date of Patent: Mar. 12, 2024

(54) FOOTING AND FOUNDATION WALL DRAINAGE SYSTEM

(71) Applicant: K.C. Waterproofing, Inc., North Kansas City, MO (US)

(72) Inventors: Donald E. Derry, North Kansas City, MO (US); Drake L. Koch, Kansas City, MO (US)

(73) Assignee: Donald E. Derry, North Kansas City, MO (US)

( * ) Notice: Subject to any disclaimer, the term of this patent is extended or adjusted under 35 U.S.C. 154(b) by 298 days.

(21) Appl. No.: 17/649,612

(22) Filed: Feb. 1, 2022

(65) Prior Publication Data

US 2023/0038717 A1 Feb. 9, 2023

Related U.S. Application Data

(60) Provisional application No. 63/228,850, filed on Aug. 3, 2021.

(51) Int. Cl.
*E02D 31/02* (2006.01)
*E04B 1/70* (2006.01)

(52) U.S. Cl.
CPC ..... *E02D 31/02* (2013.01); *E04B 1/70* (2013.01)

(58) Field of Classification Search
CPC . E02D 31/02; E02D 19/00; E04B 1/70; E04B 1/7023; E04B 1/7038
See application file for complete search history.

(56) References Cited

U.S. PATENT DOCUMENTS 4,333,281 A * 6/1982 Scarfone ..... E04B 1/7023 52/302.3
4,773,195 A * 9/1988 Waller ..... E04B 1/0023 52/302.3
4,879,851 A * 11/1989 Boccia ..... E02D 31/02 52/302.3
5,501,044 A * 3/1996 Janesky ..... E04B 1/7023 52/287.1
5,660,008 A * 8/1997 Bevilacqua ..... E02D 31/02 138/92

(Continued)

OTHER PUBLICATIONS

Interior Basement Waterproofing Footer System, waterproof.com, https://waterproof.com/product/drain-main-basement-waterproofing-footer-system/?gclid=EAlalQobChMluKvQkMGV8gIVSmxvBB1M GwdBEAkYBCABEgIVWPD_BwE, dated Aug. 3, 2021.

(Continued)

*Primary Examiner* — Gisele D Ford
(74) *Attorney, Agent, or Firm* — Lathrop GPM LLP; Robert J. Lambrechts

(57) ABSTRACT

Disclosed herein is a system for draining groundwater away from a substantially vertical foundation wall that extends beneath the surface of the ground, and which has an exterior surface in contact with the ground. The drainage system includes a drainage structure that extends longitudinally along an entire interior foundation wall footing. The drainage structure is fabricated from a plurality of foldable polypropylene panels that are secured to and are adjacent to the foundation footing. The drainage structure forms a drainage channel that facilitates the flow of infiltration water to a sump pump or other means for ejecting water, and extracted radon, from proximate the foundation.

22 Claims, 8 Drawing Sheets

(56) References Cited

U.S. PATENT DOCUMENTS 5,694,723 A * 12/1997 Parker ..... E02D 27/32 404/4
5,765,323 A * 6/1998 Bevilacqua ..... E04B 1/7023 138/92
5,771,643 A * 6/1998 Parker ..... E02D 27/32 52/302.1
5,784,838 A 7/1998 Phillips
5,970,671 A * 10/1999 Bifano ..... E04B 1/765 428/603
6,308,470 B1 * 10/2001 Durkovic ..... E04B 1/70 405/36
6,550,190 B2 4/2003 Ruiz et al.
7,546,719 B1 * 6/2009 Guevara ..... E04F 13/06 52/716.2
7,810,291 B2 10/2010 McPherson
7,832,150 B1 * 11/2010 Pratt ..... E04B 1/7023 52/716.2
7,836,640 B1 11/2010 Pratt
8,186,127 B1 * 5/2012 Pratt ..... E02D 31/02 52/302.1
8,596,002 B2 12/2013 Andras
8,607,525 B2 12/2013 Trotter
10,196,812 B1 * 2/2019 Duffy ..... E04F 13/007
10,443,204 B2 * 10/2019 Clapper ..... E04G 11/06
10,662,607 B2 5/2020 Trebil
10,829,904 B1 11/2020 McPherson
2005/0204653 A1 9/2005 Matthews
2006/0150551 A1 7/2006 Bounds et al.
2007/0044396 A1 * 3/2007 Janesky ..... E02D 31/02 52/169.5
2008/0190045 A1 * 8/2008 Janesky ..... E02D 31/02 52/169.5
2009/0183445 A1 * 7/2009 McPherson ..... E02D 31/02 52/302.3
2009/0223147 A1 * 9/2009 Spignesi ..... E04F 17/00 52/302.3
2010/0206398 A1 * 8/2010 Nordhoff ..... E04B 1/7023 29/428
2012/0174495 A1 * 7/2012 Nolan ..... E04F 19/02 52/58
2013/0036691 A1 2/2013 Janesky
2018/0044876 A1 * 2/2018 Clapper ..... E02D 19/00
2020/0063393 A1 * 2/2020 Trebil ..... E04B 1/7023
2020/0240100 A1 * 7/2020 Bayless ..... E02D 31/02
2020/0270859 A1 * 8/2020 Nowak ..... E02D 27/01
2020/0370267 A1 * 11/2020 Nowak ..... E04B 1/665
2021/0087808 A1 3/2021 Hunter
2021/0102372 A1 * 4/2021 Preston ..... E04B 1/7046

OTHER PUBLICATIONS

Remedial Drainage Options, waterproof magazine, https://www.waterproofmag.com/2016/06/remedial-drainage-options/, Aug. 3, 2021.
French Drain or Drain Tile System for Leaky Wet Basement, https://www.basementsystems.ca/basement/waterproofing/products/french-drain-system.html, dated Aug. 3, 2021.
The Importance of an Interior Drainage System, https://www.aquaguard.net/resources/basement-waterproofing/the-importance-of-an-interior-drainage-system/, dated Aug. 3, 2021.
Below-Grade Residential Drainage Boards & Footing, https://www.waterproofmag.com/2007/10/below-grade-residential-drainage-boards-footing-drains/, dated Aug. 3, 2021.

* cited by examiner

FOOTING AND FOUNDATION WALL DRAINAGE SYSTEM

CROSS-REFERENCE TO RELATED APPLICATION

This application claims priority from U.S. Provisional Application No. 63/228,850 filed Aug. 3, 2021, the entire contents of which are incorporated herein by reference.

FIELD OF THE DISCLOSURE

This disclosure is directed to a system for basement waterproofing and, more particularly, to sump systems and methods for use in basement waterproofing systems.

BACKGROUND

The major problem to be solved is the reduction of, or the elimination of, the detrimental effects of ground water near footings that enter the building structure. Solutions to this major problem lower the water level near the footings. In most locations, underground structures, such as footings, are subject to hydrostatic pressure from ground water. A high-water level outside of a footing causes an unbalanced pressure acting sideways against the footing. If the water level gets high enough, an unbalanced pressure acting sideways can be exerted on the wall supported by the footing. Footings and supported walls are not usually designed for such pressures, and eventually water will seep into the building through cracks or joints.

The potential for moisture in the basement of buildings is of ongoing concern to homeowners, building contractors, and structural engineers. Basement foundation footings are typically located several feet below ground level, and water may accumulate around the foundation as the groundwater level periodically rises, for example, due to rain or melting snow. As a result, hydrostatic pressure may build causing leakage at cracks in the footings, structural interfaces, and through the floor. Concrete, typically used in the construction of foundations, attracts groundwater by sorption, and capillary forces in the concrete pores facilitate further penetration of the groundwater. Seepage of groundwater into a basement can cause significant structural damage, as well as promote the growth of harmful bacteria.

A problem in many basements is wet or damp basement floors caused by water seeping under the foundation wall and flowing up between the foundation wall and the basement floor. It is not practical, or even desirable, to prevent water from seeping under the foundation wall. Water pressure build-up behind the wall can damage the wall. Therefore, drainage systems are used to provide a flow path for water entering between the foundation wall and footing to a sump, thus preventing the water from flowing up between the foundation wall and basement floor.

Furthermore, dangerous radon gas, and water vapors contributing to a high basement humidity level, can flow easily through the concrete pores. Interior, sub-floor drainage systems have been developed to address problems with moisture in basements. Such systems typically include various configurations of a drainage conduit installed along the interior perimeter of the basement, positioned below the basement floor and near the foundation wall. The drainage conduit serves to collect and convey groundwater to a basement sump for extraction.

Prior art interior sub-floor systems typically fail to address the seepage that occurs above and below footings, generally focusing on just one area of seepage. Moreover, these systems are positioned at such an elevated level that when covered with concrete to achieve flushness with the existing floor they lack sufficient thickness of concrete and the concrete is susceptible to cracking and fracture when even a modest load is applied over the interior sub-floor system.

SUMMARY

A low cost easy to install system for drainage of a cast concrete or block footing, including placing a polypropylene drainage channel adjacent and atop the interior surfaces of the footing. The drainage channel which is canted at an appropriate angle to facilitate flow of the water in the desired direction, is in fluid communication with a sump pump. The drainage channel is supported in position by fasteners and gravel is backfilled beneath the channel. Concrete is poured over the drainage channel with sufficient thickness to provide a durable surface that is suitably leveled with the original flooring and can bear a load without fracturing. It is an object of the system as disclosed herein to provide a robust drainage system to capture water infiltrating beneath the footing as well as past the junction of the footing and the foundation wall and to convey the infiltrated water, by gravity flow, to a point of ejection.

It is a further object of the system disclosed herein to provide a sediment trap within the drainage channel to remove accumulated sediment carried into the drainage channel by infiltrating water.

It is a further object of the system disclosed herein to facilitate the capture of radon and route the captured radon along the drainage channel to an extraction unit for ejection to ambient air.

It is a further object of the system disclosed herein to install sufficient thickness of concrete over the system to reduce the potential for fracture and breakage of the concrete upon exposure to compressive forces.

It is a further object of the system to provide a simple to install and lightweight system that is easy to transport and assemble on site.

It is a further object of the system to utilize materials that are inexpensive to procure and that are resistant to degradation upon being exposed to moisture, concrete, insects and soil.

The contents of this summary section are provided only as a simplified introduction to the disclosure, and are not intended to be used to limit the scope of the appended claims.

DETAILED DESCRIPTION

Figure 1:
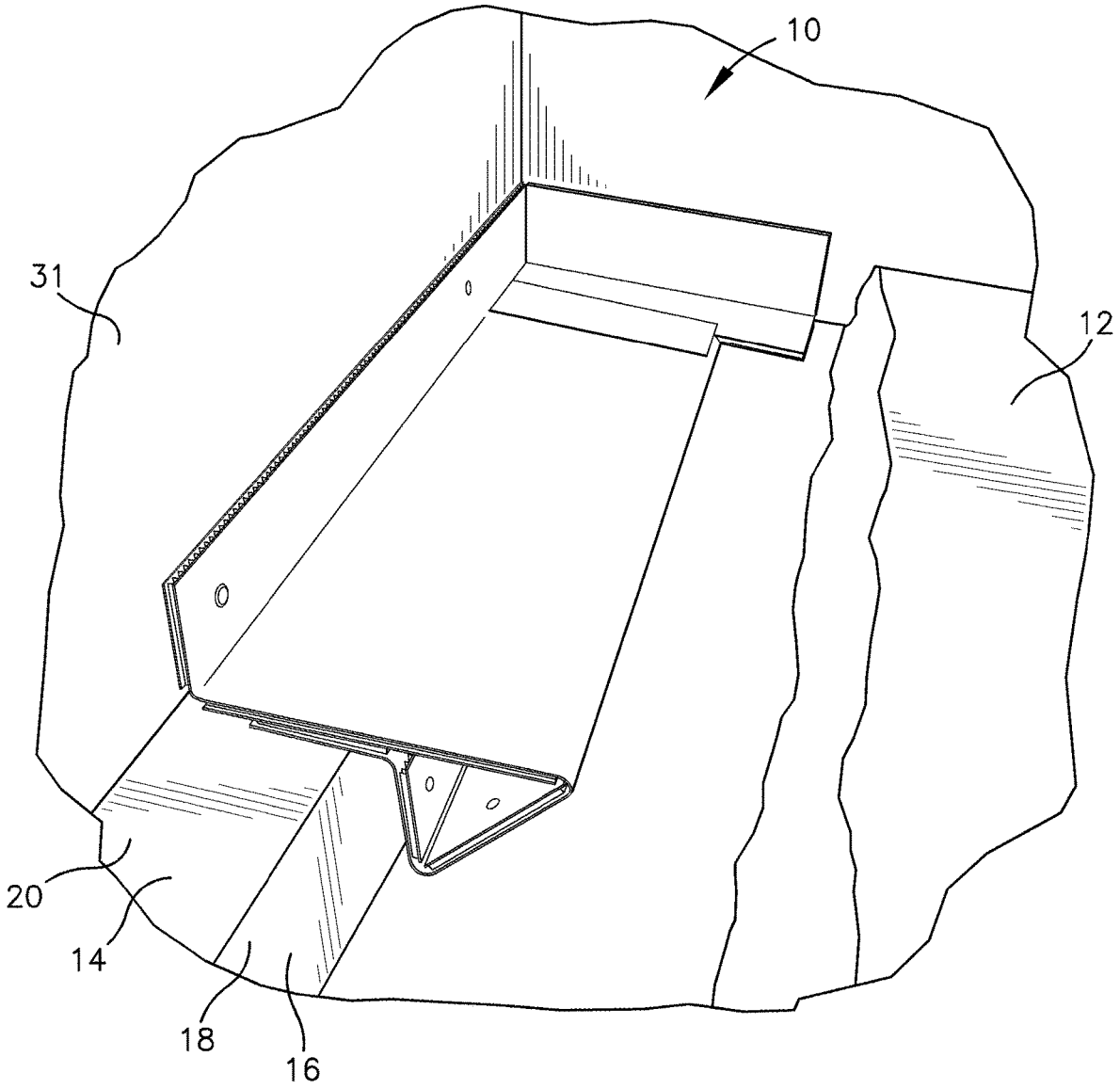
FIG. 1 illustrates an embodiment of a partially installed drainage system positioned adjacent a footing.

Referring now to the drawings, and first to FIG. 1, the footing drainage system 10 as disclosed herein is shown partially installed. Prior to any installation of the drainage system 10, the area proximate the footing must be sufficiently excavated to create space for installation of the system 10. The concrete floor 12 must be excavated to expose both the horizontal and upper vertical surfaces 14, 16 of the interior side 18 of the footing 20 of the building. The objective is to excavate sufficiently back from the footing 20 to allow space for installation of the system 10 as well as to allow for backfilling with gravel and then covering the system 10 with concrete as is discussed in greater detail below.

Figure 2:
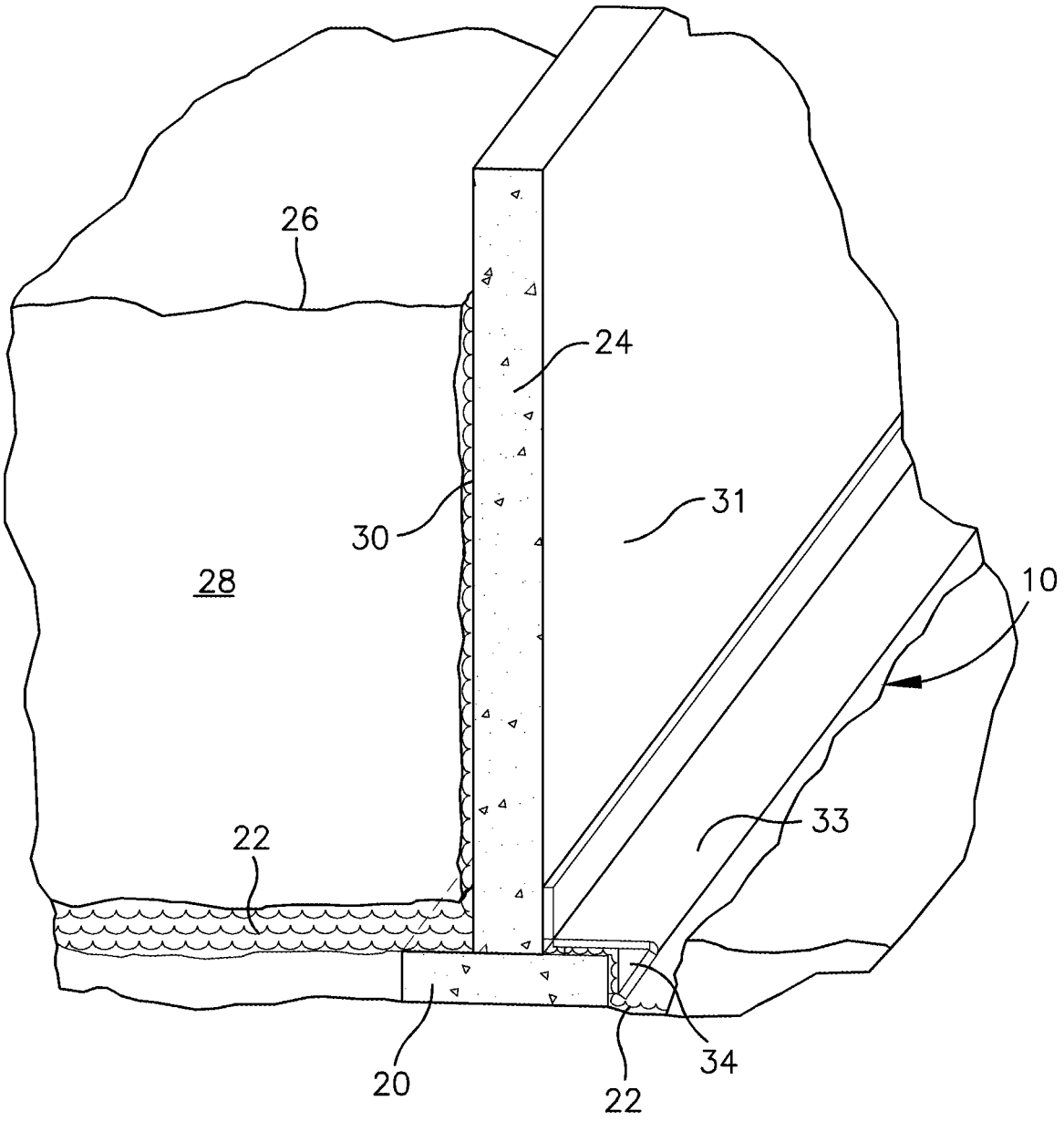
FIG. 2 illustrates an embodiment of the system disposed adjacent a footing and a foundation wall detailing soil and groundwater on the exterior side of the foundation wall.

Referring to FIG. 2, the drainage system 10 as disclosed herein is configured to drain infiltrating groundwater 22 away from a substantially vertical foundation wall 24 that extends beneath the surface 26 of the soil 28 and which has an exterior surface 30 in contact with soil 28. The drainage system 10 incorporates a drainage channel 34 that extends longitudinally along the footing 20 of the interior surface 31 of the foundation wall 24.

Figure 3:
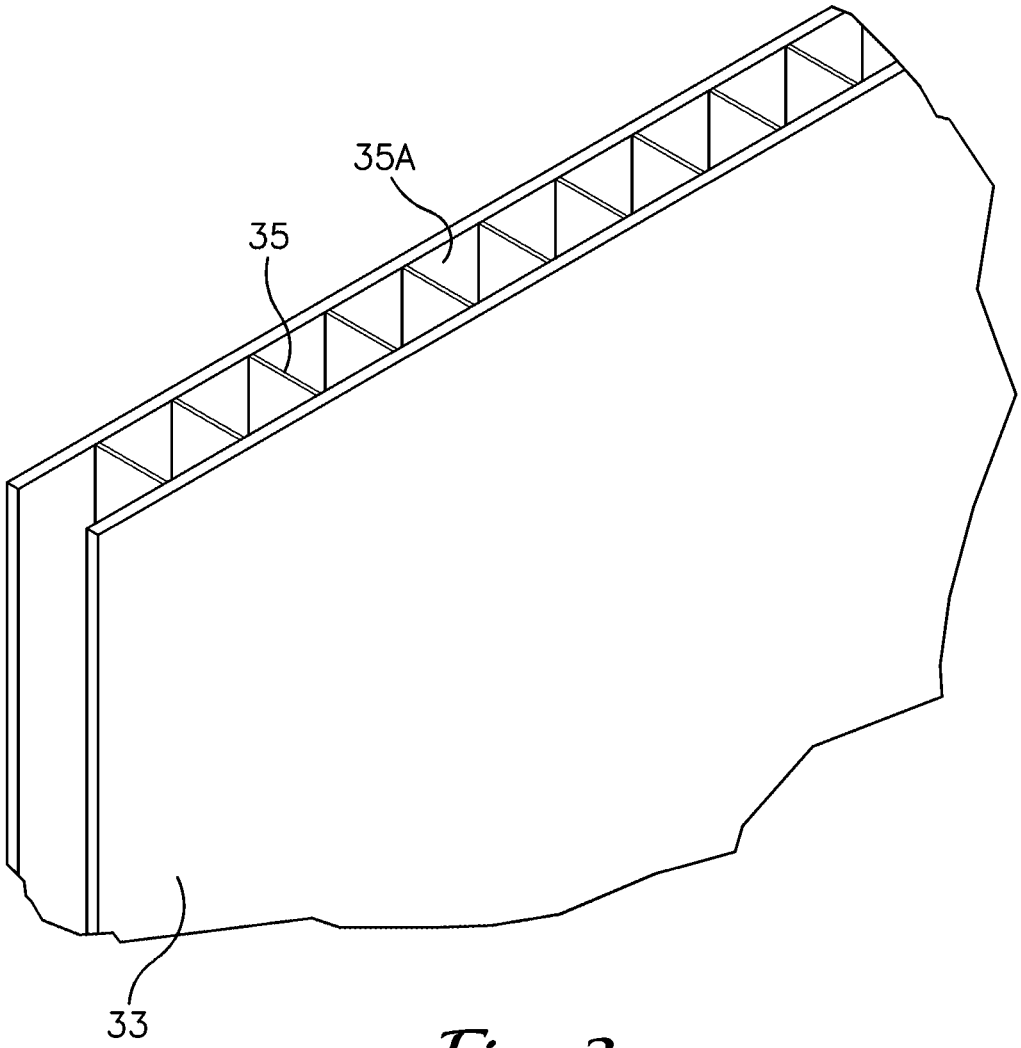
FIG. 3 illustrates an edge of an embodiment of a sheet of corrugated polypropylene.

The channel 34 is fabricated from sheets 33 of corrugated polypropylene. Exemplary polypropylene sheets 33 are available from Curbell Plastics™ located in Orchard Park, New York. The corrugated polypropylene sheets 33 may be procured in numerous dimensions such as 96-inch lengths and widths of 48 or 60-inches. The thickness of these sheets ranges from a 2-15 mm. The preferred width of the sheets for the system as disclosed herein is 48 inches and the preferred thickness is 10 mm; however, other widths and thicknesses are also contemplated by this disclosure. As illustrated at FIG. 3, the corrugations 35 effectively serve as lumens 35A through which migrating groundwater 22 may be transported to the channel 34.

Figure 4:
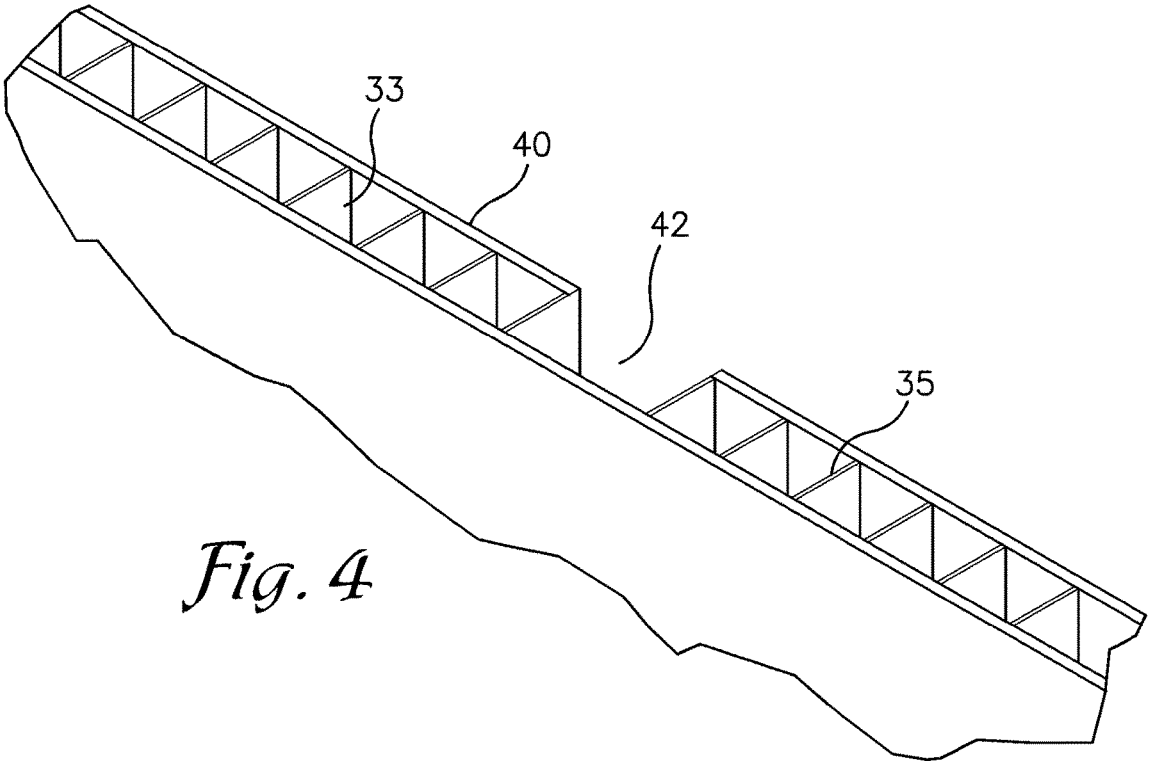
FIG. 4 illustrates an edge of an embodiment of a sheet of corrugated polypropylene with a routed section.
Figure 4A:
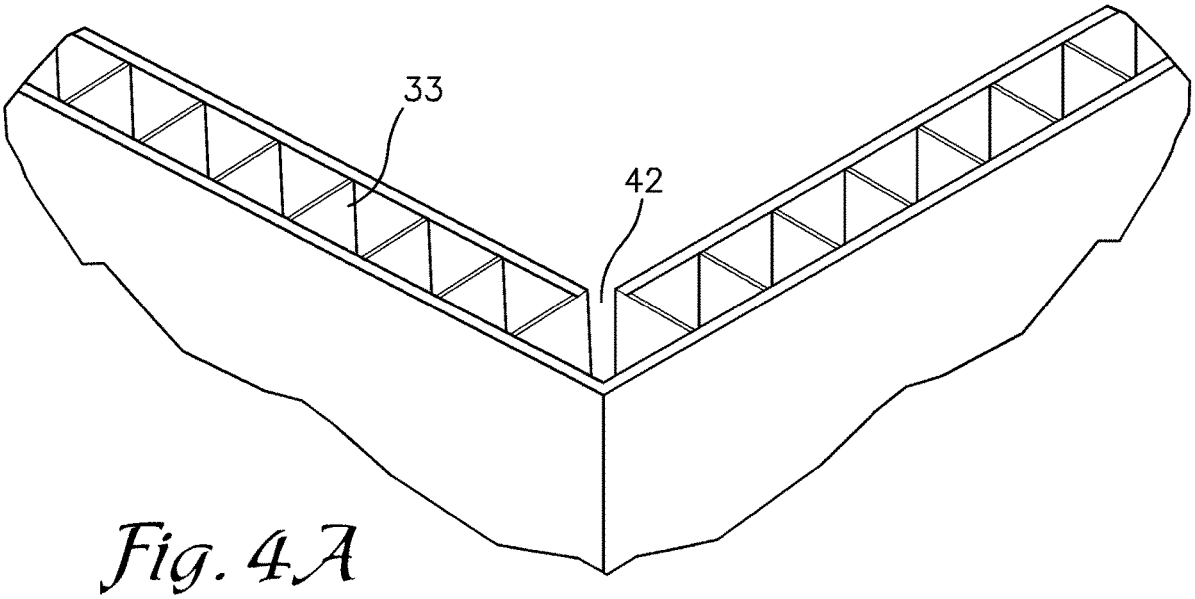
FIG. 4A illustrates an edge of an embodiment of a sheet of corrugated polypropylene with the sheet bent at a routed section.

As illustrated at FIG. 4, the drainage system 10 fabricated from the polypropylene sheets 33 by routing with a cutting bit to form the various longitudinally extending panels 38 that will be discussed in greater detail below. The routing procedure removes a narrow strip of top layer 40 and the underlying corrugations 35 of the sheet 33 forming a narrow flex segment 42 leaving only a thin layer of polypropylene creating a region where flexure of the sheet 33 is readily achievable. A sheet 33 flexed at the flex segment 42 is illustrated at FIG. 4A. The width of these flex segments 42 may span between 0.5 and 1.0 inches with a preferred span of 0.875 inches. Any reference to "flexibly secured" throughout this detailed description is intended to convey that the sheet 36 has been routed at that flex segment 42 and the flex segment 42 is where the panels 38 are connected to one another and bend relative to one another. The sheet 33 may be easily folded along these routed flex segments 42 thereby facilitating the forming of the desired orientation of the various panels 38 relative to one another as is detailed below.

The following discussion of the various panels are contemplated in an as-built and installed system 10 configuration. Specifically, reference to horizontal and vertical orientations in this disclosure are to be understood as in relation to the footing and foundation wall where the system 10 is installed.

Figure 5:
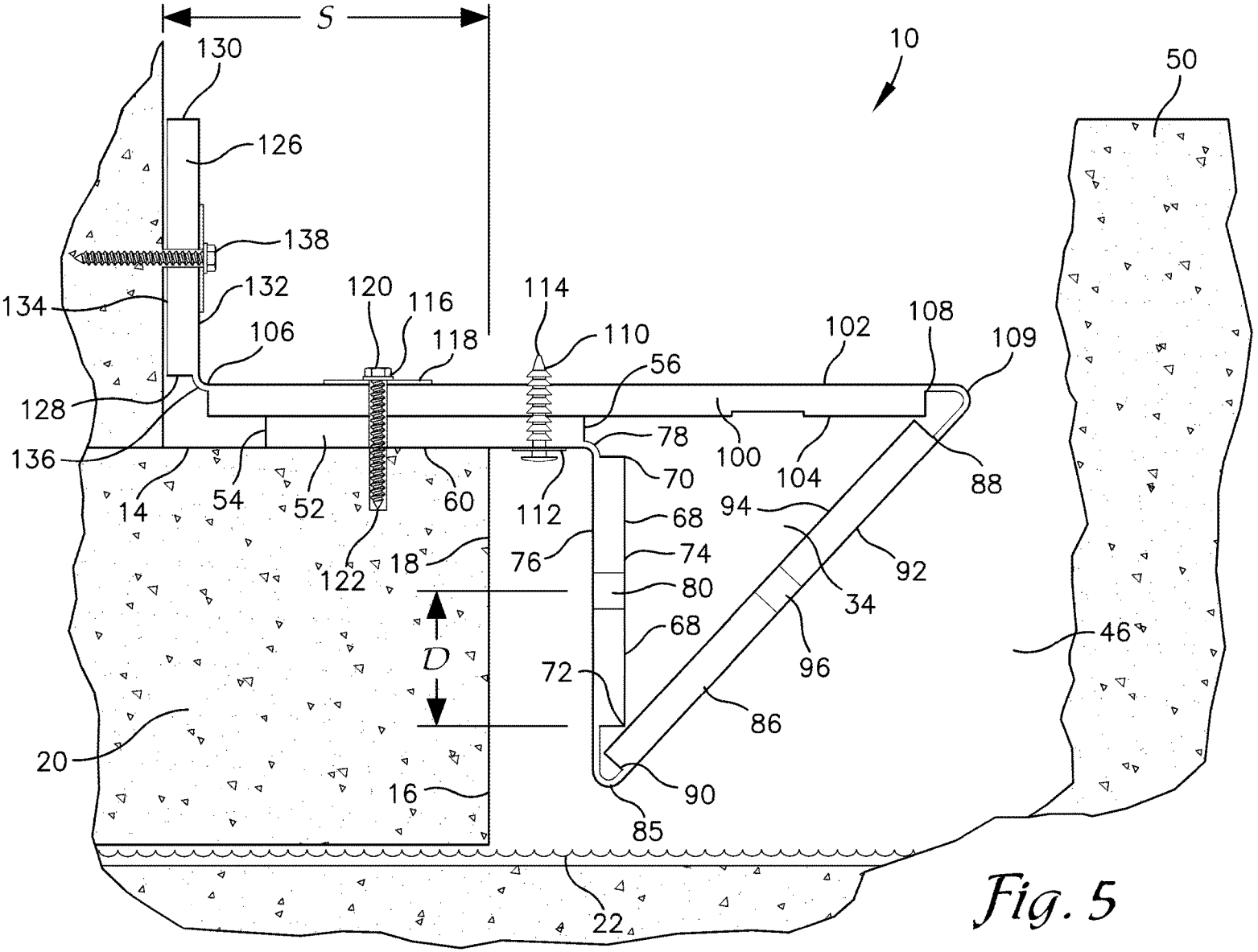
FIG. 5 illustrates a cross-sectional elevation view of an embodiment of the system detailing a configuration of panels in position atop and adjacent a footing.

Referring now to FIG. 5 which illustrates a cross sectional view of the drainage system 10 within an excavated space 46, or alternatively in a space prior to original placement of the concrete slab 50. Fabricated from a routed polypropylene sheet 33 as detailed above, the drainage system 10 as disclosed herein includes a first longitudinally extending horizontal panel 52 with a first edge 54 and a second edge 56, an upper surface 58 and a lower surface 60. The lower surface 60 is in contact with the upper horizontal surface 14 of the footing 20 located on the interior side 18 of footing of the building.

Referring again to FIG. 5, the system 10 also includes a first longitudinally extending vertical panel 68 that extends parallel to the vertical face 16 of the interior side 18 of the footing 20. The first vertical panel 68 further comprises an upper edge 70 and a lower edge 72 as well as a front face 74 and a rear face 76. The rear face 76 may or may not be in contact with the vertical face 16 of the footing 20 depending upon the span S of the horizontal surface 14 of the footing 20 between the vertical face 16 of the footing 20 and the vertical foundation wall 24. The upper edge 70 is flexibly secured to the second edge 56 of the first horizontal panel 52 at an area 78 that has been routed. The first longitudinally extending vertical panel 68 also includes a plurality of through holes 80 that are spaced with a frequency that facilitates the entry of ground water 22 into the channel 34 for gravity induced drainage to the point of ejection 82, by use of, for example, a sump pump 84.

The ground water 22 entering the channel 34 through holes 80 may emanate from beneath the footings 20 or infiltrate between the base of the foundation wall 24 and the upper horizontal surface 14 of the footing 20 or possibly ground water 22 intrudes through both areas. The through holes 80 are disposed a distance D above the lower edge 72 of the first longitudinally extending vertical panel 68. Positioning the through holes 80 a distance D above the lower edge 72 provides sufficient height for the ground water 22 entering the channel 34 to drop into the channel 34 and drain to the point of ejection 82.

The placement of the through holes 80 along the longitudinally extending panel 68 is preferably about one through hole every linear foot; however, more frequent or less frequent placement of the holes is also contemplated by this disclosure. The diameter of the through holes 80 is preferably in the range of from 0.35 to 0.65 inches with a most preferred diameter of about 0.5 inches. The frequency of the through holes 80 is dictated by the anticipated volume of ground water 22 that the installer estimates the system 10 shall encounter based upon local meteorological conditions, topography of the land adjacent the building and robustness of current, or proposed, drainage systems exterior to the building.

Returning to FIG. 5, secured to the lower edge 72 of the first longitudinally extending vertical panel 68, at a routed area 85, is a diagonally disposed longitudinally extending panel 86 with an upper edge 88, a lower edge 90, an outer face 92, and an inner face 94. The diagonally disposed longitudinally extending panel 86 is preferably canted at an angle in the range of 30 to 60 degrees from horizontal, a more preferred embodiment of the diagonally disposed panel 86 is canted at an angle of about 45 degrees from horizontal. The lower edge 72 of the first longitudinally extending vertical panel 68 is flexibly secured to the diagonally disposed longitudinally extending panel 86 at the lower edge 90 of the diagonal panel 86.

The first longitudinally extending vertical panel 68 and the diagonally disposed longitudinally extending panel 86 form the V-shaped channel 34 into which infiltrating groundwater 22 also flows from intermittently disposed openings 96 in the diagonally disposed longitudinally extending vertical panel 86. This ground water 22 is in addition to the ground water 22 flowing into the channel 34 through openings 80 in the first longitudinally extending vertical panel 68. As previously noted, infiltrating ground water 22 may originate from beneath the footing 20, along the plane of contact between the upper horizontal surface 14 of the footing 20 and the foundation wall 24, or possibly both. No matter the origins of the ground water 22, due to gravity and hydrostatic pressure, the water traverses into the openings 80, 96 and then into the channel 34. The openings 96 in the diagonally disposed longitudinally extending panel 86 are preferably spaced apart by about every linear foot. Additionally, the diameter of the openings 96 may range from 0.35 inches to 0.65 inches with a preferred diameter of the opening 96 at about 0.50 inches.

Returning to FIG. 5, the system 10 also includes a second longitudinally extending horizontal panel 100 with an upper surface 102, a lower surface 104, a first edge 106 and a second edge 108. The second edge 108 of the second longitudinally extending horizontal panel 100 is flexibly secured to the upper edge 88 of the diagonally disposed longitudinally extending panel 86 at a third flex segment 109. The lower surface 104 of the second longitudinally extending horizontal panel 100 is disposed atop the upper surface 58 of the first longitudinally extending horizontal panel 52.

A first fastener 110 extends through the first longitudinally extending horizontal panel 52 as well as the second longitudinally extending horizontal panel 100. This fastener 110 preferably employs a thin flat head 112 that prevents pull-through and a pointed tip 114 for fully penetrating the overlain panels 52, 100. Fasteners with a 0.25-inch diameter tip 114 and a 0.5-inch diameter head 112 are preferred in this application. These fasteners are optimally spaced about every linear foot along the longitudinally extending panels 52, 100.

A second fastener 116 may also optionally be employed in this embodiment. The second fastener 116, is disposed closer to the vertical foundation wall 24 than the first fastener 110. The second fastener 116 extends downwardly from the top, starting at panel 52 and passing through the second longitudinally extending horizontal panel 100. A washer 118 with a diameter considerably greater than the diameter of the head 120 of the second fastener 116 prevents pull-through of the fastener 116. The tip 122 of this fastener 116 is preferably sunk into the concrete of the horizontal surface 14 of the footing 20 and thereby serves to anchor the two panels 52, 100 in position. The second fastener 116 is preferably spaced approximately every linear foot along the longitudinal extension of the panel.

The final flexibly connected panel utilized in the system 10 is a second longitudinally extending vertical panel 126 with a lower edge 128, an upper edge 130, a front face 132 and a rear face 134. The lower edge 128 is flexibly secured to the first edge 106 of the second longitudinally extending horizontal panel 100 at a routed area 136 and the rear face 134 is in abutting contact with the vertical foundation wall 24 above the footing 20. Fasteners 138 penetrate the second vertical panel 126 and secure the longitudinally extending panel to the foundation wall 24. A preferred embodiment of the fastener 138 is a concrete anchor screw. The second longitudinally extending vertical panel 126 is preferably about 4 inches in height. The fastener 138 is preferably positioned approximately 2 inches below the upper edge 130. This centralized location of approximately 2 inches above the horizontal surface of the footing 14 and approximately 2 inches below the upper edge 130 is a mid-point M on this panel 126 and provides stability for maintaining the panel in position. The 4-inch height of the second vertical panel 126 supports a concrete thickness of approximately 4 inches which is sufficiently thick to support most loads in both residential and many commercial buildings.

Because the longitudinal span of the footing 20 and foundation wall 24 may be greater than the longitudinal span of the panel lengths 52, 68, 86, 100, 126, a waterproof tape is preferably employed to secure adjacent panels to one another and to extend the system to recover intruding water along an entire interior wall 24 and footing 20 of a building. In addition, when panels are joined at a corner, waterproof tape is employed to create a watertight corner seal. An exemplary waterproof and high bond strength tape for joining longitudinally adjacent drainage system panels is Flex Tape® produced by Swift Response, LLC.

The system 10 must be installed such that the drainage channel 34 flows toward the point of ejection 82. To achieve this flow direction, various spacers or shims may be utilized beneath the channel 34 to achieve the desired direction of flow of the ground water 22. The spacers or shims are preferably disposed beneath the first longitudinally extending horizontal panel 52 at the furthest most distance from the point of ejection 82. By slightly elevating the horizontal panel 52 at this outer end 144.

Figure 6:
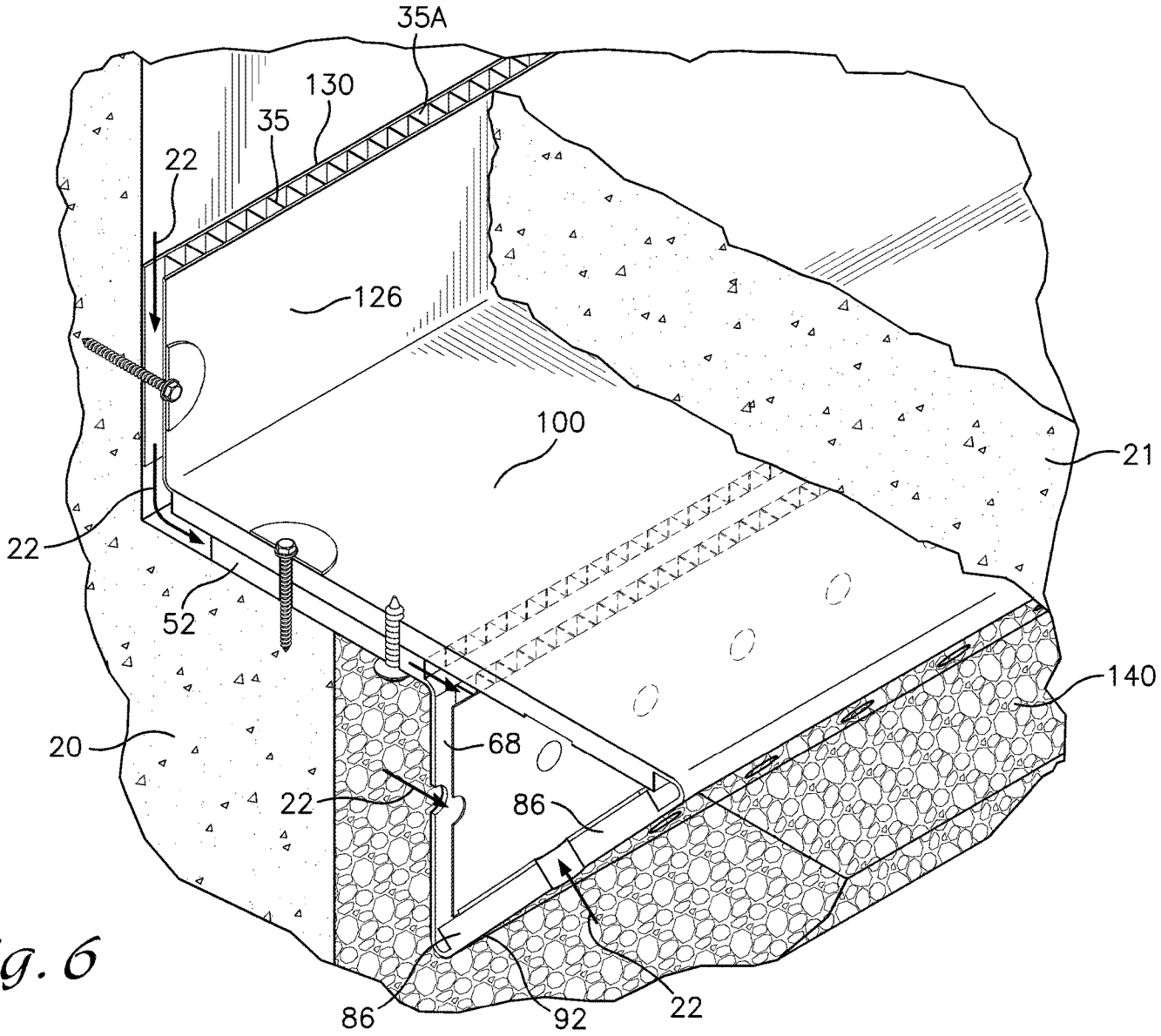
FIG. 6 illustrates a perspective view of an embodiment of the system.

As best illustrated in FIG. 6, once the various panels 52, 68, 86, 100, 126 are installed atop and adjacent the footing 20, gravel 140 is backfilled into contact with the outer face 92 of the diagonal panel 86, concrete 21 is poured and leveled into position to an elevation that is flush with an existing floor and roughly equivalent to the upper edge 130 of the second horizontal segment 90.

A preferred installation procedure is to cover the corrugation lumens 35A of the upper edge 130 of the second vertically extending panel 126 with tape during installation of the concrete 21. Once the concrete 21 is in place and has been properly surfaced and cured, the tape is removed. This procedure leaves the corrugation lumens 35A unclogged with concrete and available to collect moisture seeping through to the interior side 18 of the footing 20 as illustrated in FIG. 6. If the moisture emanates from above the level of the upper edge 130 the moisture will travel down the interior surface of the foundation wall 24 and into the lumens 35A of the second vertically extending panel 126. The moisture will ultimately traverse along the lumens 35A of the various corrugated polypropylene panels and into the channel 34.

An additional attribute of the system 10 as disclosed herein is that upon installation of the system and once covered with cured concrete 21 one or more slab level drain holes 150 may be drilled into the cured concrete. These slab level drain holes (not shown) allow water to drain from the floor into the drain holes and to enter the channel 34, flow to, for example the sump pit 152, and then be ejected by the sump pump 84.

Figure 8:
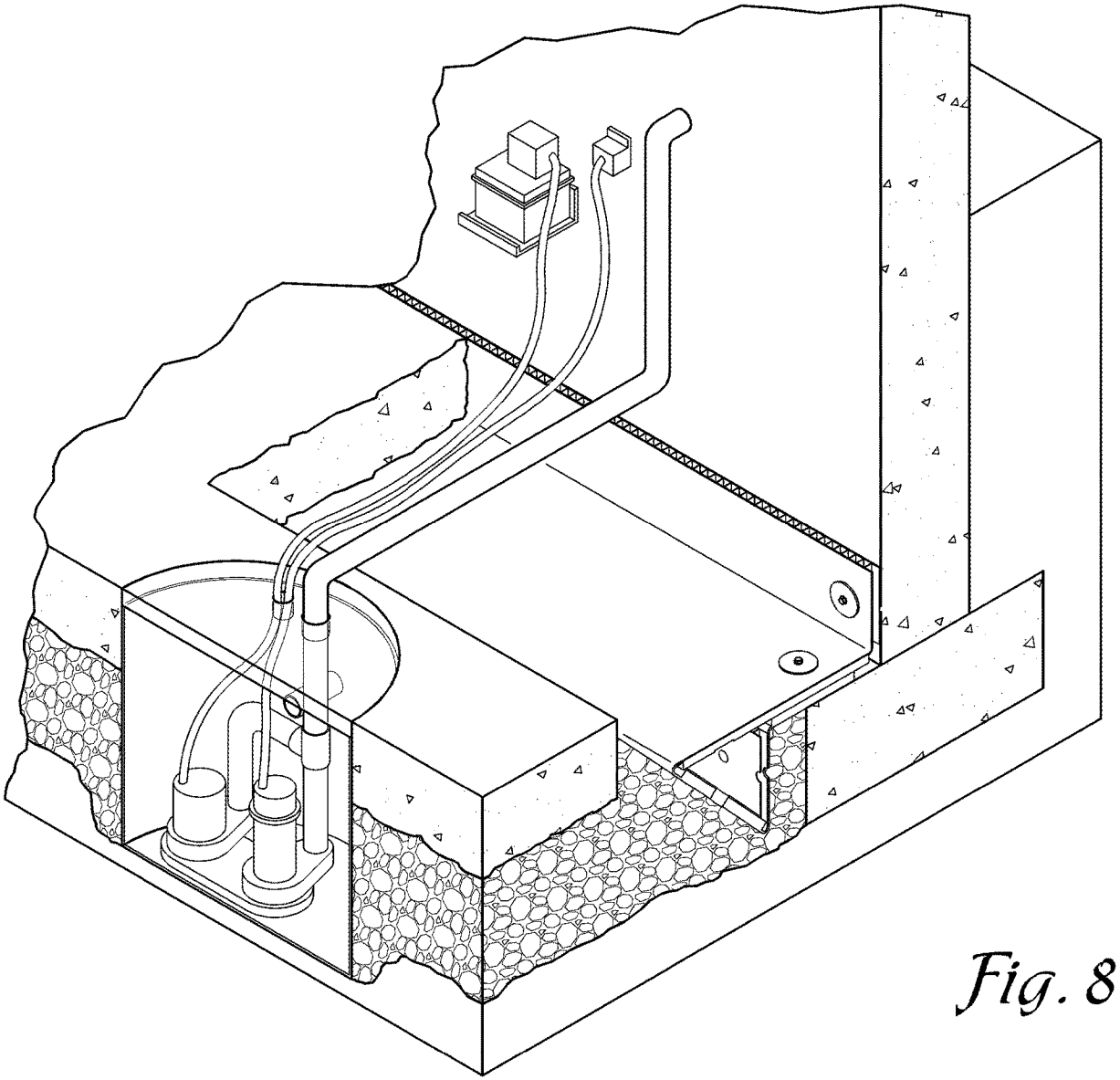
FIG. 8 illustrates a perspective view of an embodiment of the system and including the point of ejection of collected groundwater and radon.

Referring again to FIG. 6, the gravel 140 serves a critical role by allowing the ground water 22 to percolate toward the system 10 and specifically the through holes 80, 96, illustrated at FIG. 5, prior to entry into the drainage channel 34 for transport, via gravity, to the point of ejection 82 such as a sump pit illustrated at FIG. 8. If the excavated space 46 is backfilled with concrete only, the concrete will effectively prohibit the movement of ground water 22 to the holes 80, 96 and into the channel 34. Consequently, backfilling the entire excavated space 46 with non-permeable, e.g., high clay content soil, or concrete, would be a detriment to the efficient removal of the ground water 22.

Figure 7:
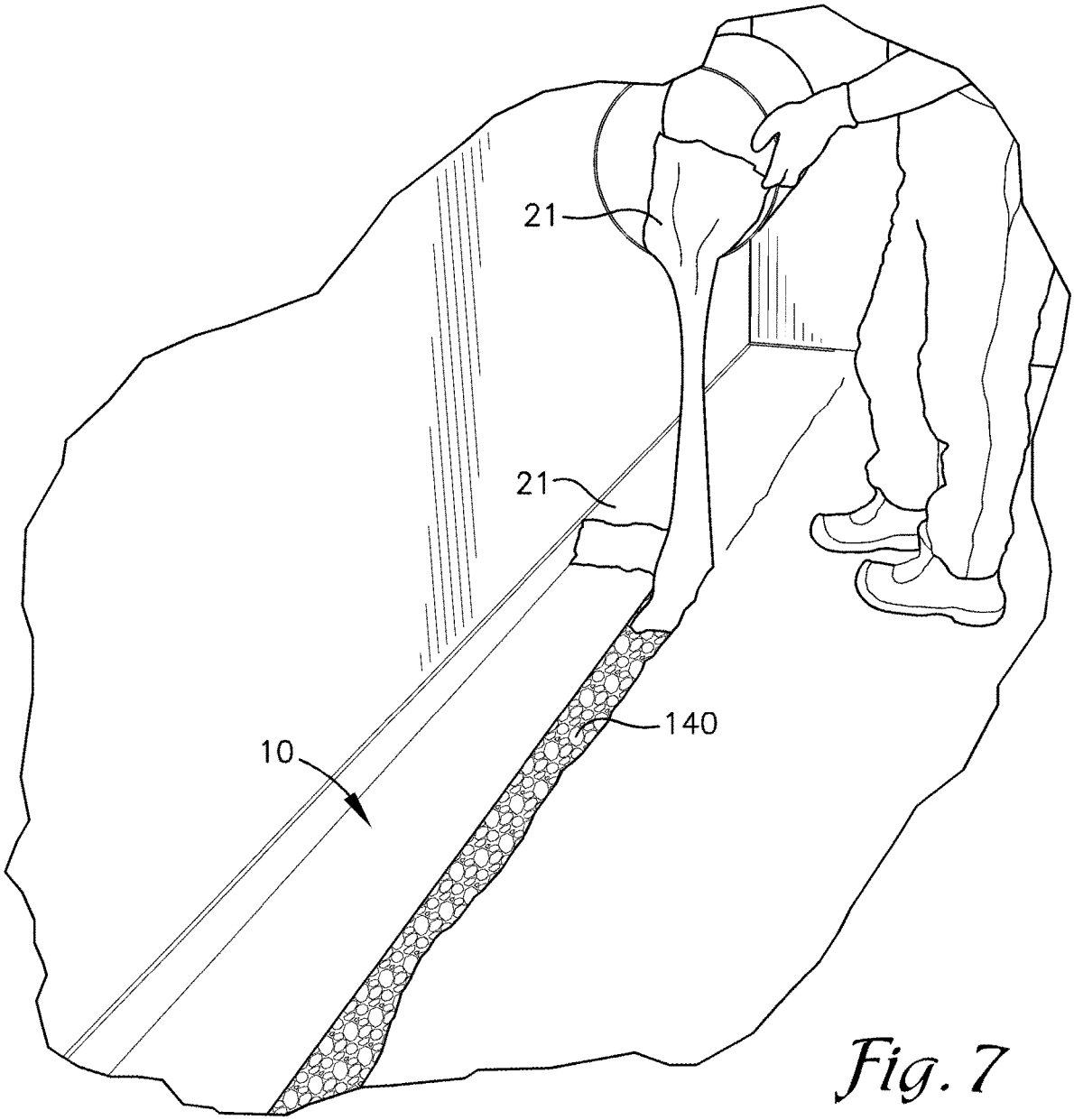
FIG. 7 illustrates the pouring of concrete atop an embodiment of an installed system.

Backfilling may include, as necessary, the space 146 between the first longitudinally extending vertical segment 68 and the foundation wall 24 with gravel 140 should the first horizontally disposed longitudinally extending segment 52 extend farther than the horizontal surface of the footing 14. This methodology for backfilling as previously noted, facilitates the drainage of ground water 22 from around the footing 20. FIG. 7 illustrates the pouring of concrete 21 atop the installed system 10 and backfilled gravel 140. This final step effectively seals the system 10 in place below the level of the floor.

FIG. 8 illustrates how the system 10 may also be employed to remove radon from the building 21. Radon often enters a structure through cracks in the lowest level of flooring and around foundation footings. With the system 10 as disclosed herein, radon may enter the channel 34 through the openings 80, 96 in the channel. A radon extraction system may be employed to draw air laden with radon gas from the end of the channel 154. The radon gas is effectively sealed within the channel 34 after entering through the openings 80, 96 and is drawn toward the end of the channel 34 where is ejected by the fan of the radon extraction system.

Although the invention has been described above with reference to one or more preferred embodiments, it will be appreciated that various changes or modifications may be made without departing from the scope of the invention as defined in the appended claims.

The disclosed embodiments of the drainage system detailed above provide a wide range of options for efficiently and cost-effectively installing a drainage system adjacent to the footings and foundation walls of a building. The disclosed system should not be construed as limiting in any way. Instead, the present disclosure is directed toward all novel and nonobvious features and aspects of the various disclosed embodiments, alone and in various combinations and sub-combinations with one another. The disclosed apparatus and systems are not limited to any specific aspect or feature or combination thereof, nor do the disclosed embodiments require that any one or more specific advantages be present or problems be solved.

In view of the many possible embodiments to which the principles of the disclosed invention may be applied, it should be recognized that the illustrated embodiment is only an example of the disclosure and should not be taken as limiting the scope of the invention. Rather, the scope of the invention is defined by the following claims. We therefore claim as our invention all that comes within the scope of these claims.

The disclosure presented herein is believed to encompass at least one distinct invention with independent utility. While the at least one invention has been disclosed in exemplary forms, the specific embodiments thereof as described and illustrated herein are not to be considered in a limiting sense, as numerous variations are possible. Equivalent changes, modifications, and variations of the variety of embodiments, materials, compositions, and methods may be made within the scope of the present disclosure, achieving substantially similar results. The subject matter of the at least one invention includes all novel and non-obvious combinations and sub-combinations of the various elements, features, functions and/or properties disclosed herein and their equivalents.

Benefits, other advantages, and solutions to problems have been described herein regarding specific embodiments. However, the benefits, advantages, solutions to problems, and any element or combination of elements that may cause any benefits, advantage, or solution to occur or become more pronounced are not to be considered as critical, required, or essential features or elements of any or all the claims of at least one invention.

Many changes and modifications within the scope of the instant disclosure may be made without departing from the spirit thereof, and the one or more inventions described herein include all such modifications. Corresponding structures, materials, acts, and equivalents of all elements in the claims are intended to include any structure, material, or acts for performing the functions in combination with other claim elements as specifically recited. The scope of the one or more inventions should be determined by the appended claims and their legal equivalents, rather than by the examples set forth herein.

Benefits, other advantages, and solutions to problems have been described herein regarding specific embodiments. Furthermore, the connecting lines, if any, shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions.

The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

In the detailed description herein, references to "one embodiment," "an embodiment," "an example embodiment," etc., indicate that the embodiment described may include a feature, structure, or characteristic, but every embodiment may not necessarily include the feature, structure, or characteristic. Moreover, such phrases are not necessarily referring to the same embodiment. Further, when a feature, structure, or characteristic is described relating to an embodiment, it is submitted that it is within the knowledge of one skilled in the art to affect such feature, structure, or characteristic relating to other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

The invention has been described above with reference to one or more preferred embodiments, it will be appreciated that various changes or modifications may be made without departing from the scope of the invention as defined in the appended claims.

We claim:

1. A system for removing groundwater from an interior space of a building structure, the system comprising:

(a) a longitudinally extending vertical panel disposed adjacent an interior surface of a foundation wall, the longitudinally extending vertical panel further comprising longitudinally extending upper and lower edges;

(b) a longitudinally extending upper horizontal panel with opposed first and second longitudinally extending edges, the first edge of the longitudinally extending upper horizontal panel flexibly secured to the lower edge of the longitudinally extending vertical panel;

(c) a longitudinally extending perforated triangular channel with first, second and third longitudinally extending edges, the triangular channel flexibly secured to the second edge of the longitudinally extending upper horizontal panel; and (d) a longitudinally extending lower horizontal panel with a first longitudinally extending edge, the lower horizontal panel disposed beneath the longitudinally extending upper horizontal panel, the third edge of the perforated triangular channel flexibly secured to the first edge of the longitudinally extending lower horizontal panel and the lower horizontal panel is disposed atop a foundation footing; wherein migrating groundwater enters the perforations of the perforated triangular channel disposed below the surface of a floor of the interior space of the building and is conveyed to a point of ejection.

2. A kit for removing groundwater from an interior space of a building structure; the kit comprising:

a plurality of interconnected panels, the interconnected panels comprising;

(i) a first panel comprising an upper surface and a lower surface;

(ii) a second panel with an inner surface and an outer surface, the second panel connected to the first panel at a first flex segment, the second panel substantially vertically disposed with intermittent perforations therein;

(iii) a third panel with an inner and an outer surface and intermittent perforations therein, the third panel connected to the second panel at a second flex segment and extending diagonally upward forming a channel;

(iv) a fourth panel with an upper and a lower surface, the fourth panel connected to the third panel at third flex segment, at least a portion of the lower surface of the fourth panel laid atop the upper surface of the first horizontal panel; and (v) a fifth panel with an inner surface, an outer surface and a top edge, the fifth panel connected to the fourth panel at a fourth flex segment;

wherein the first horizontal panel is secured in position atop a foundation footing and surrounded by aggregate and the fifth panel is disposed adjacent a vertical foundation wall, the channel operable to receive groundwater through the intermittent perforations of the second and third panels and to facilitate groundwater flow to a point of ejection from the system.

3. The kit of claim 2, wherein the first through fourth panels are disposed beneath concrete.

4. The kit of claim 2, wherein the channel is operable to transport radon emanating from beneath the interior space of the building structure to the point of ejection.

5. A system for removing groundwater from an interior space of a building structure; the system comprising:

a foundation wall that extends beneath the surface of the ground, the foundation wall comprising an interior surface; an exterior surface and a lower surface;

a footing upon which the lower surface of the foundation wall is disposed, the footing comprising an interior horizontal surface and an interior vertical surface;

a plurality of interconnected panels, the interconnected panels comprising;

(i) a first horizontal panel disposed atop at least a portion of the interior horizontal surface of the footing, the first horizontal panel comprising an upper surface and a lower surface;

(ii) a second panel with an inner surface and an outer surface, the second panel connected to the first panel at a first flex segment, the second panel substantially vertically disposed with intermittent perforations therein and disposed in at least one of (a) contact with the interior vertical surface of the footing, or (b) proximate the interior vertical surface of the footing;

(iii) a third panel with an inner and an outer surface and intermittent perforations therein, the third panel connected to the second panel at a second flex segment and extending diagonally upward;

(iv) a fourth panel with an upper and a lower surface, the fourth panel connected to the third panel at third flex segment, at least a portion of the lower surface of the fourth panel laid atop the upper surface of the first horizontal panel; and (v) a fifth panel with an inner surface, an outer surface and a top edge, the fifth panel vertically oriented with the outer surface in contact with the foundation wall;

wherein groundwater flows through the intermittent perforations into a channel formed by the second and third panels, the groundwater moving to a point of ejection from the system.

6. The system for removing groundwater of claim 5, wherein the panels are fabricated from corrugated polypropylene with a range of 7 to 12 mm in thickness.

7. The system for removing groundwater of claim 5, wherein corrugations of the corrugated polypropylene permit movement of groundwater interior to the panels for delivery to the channel.

8. The system for removing groundwater of claim 5, wherein the first, second, third and fourth flex segments all span in the range of 0.75 to 0.90 inches.

9. The system for removing groundwater of claim 5, wherein the first through fifth panels are foldable at the flex segments to facilitate transport to a job site.

10. The system for removing groundwater of claim 5, wherein the first through fifth panels are configured to be custom routed to accommodate specific dimensions of the footing and foundation wall.

11. The system for removing groundwater of claim 5, wherein the channel is operable to receive radon entering the channel through the perforations in the second and third panels and eject the radon at the point of ejection.

12. The system for removing groundwater of claim 5, wherein the channel is operable to receive condensate water from a heating or cooling system.

13. The system for removing groundwater of claim 5, wherein a sump pump is operable to eject groundwater flowing from the channel into a sump pit.

14. The system for removing groundwater of claim 5, wherein an aggregate is disposed adjacent the second and third panels to facilitate movement of groundwater to the intermittent perforations.

15. The system for removing groundwater of claim 14, wherein concrete is disposed atop and adjacent the aggregate and the five panels to a level proximate the top edge of the fifth panel.

16. The system for removing groundwater of claim 5, wherein corrugations at the top edge of the fifth panel are operable to receive groundwater and condensation and deliver the groundwater and condensation to the channel.

17. The system for removing groundwater of claim 5, wherein the removal system is a sump pump.

18. The system for removing groundwater of claim 5, wherein at least one fastener secures the first and second longitudinally extending horizontal panels to an upper horizontal surface of the footing.

19. The system for removing groundwater of claim 5, wherein the second longitudinally extending vertical panel is secured to the vertical foundation wall with at least one fastener.

20. The system for removing groundwater of claim 5, wherein the drainage system panels are fabricated from corrugated polypropylene.

21. The system for removing groundwater of claim 20, wherein the corrugated polypropylene is in the range of 7 to 12 mm in thickness.

22. The drainage system of claim 16, wherein a port in the channel is operable to facilitate removal of sediment in the channel.

* * * * *